US012004562B2

(12) United States Patent
Lee et al.

(10) Patent No.: US 12,004,562 B2
(45) Date of Patent: Jun. 11, 2024

(54) AEROSOL GENERATING DEVICE

(71) Applicant: KT&G CORPORATION, Daejeon (KR)

(72) Inventors: Jong Sub Lee, Seongnam-si (KR); Jae Min Lee, Siheung-si (KR); Dae Nam Han, Seoul (KR); Jin Soo Seong, Seoul (KR); Sung Wook Yoon, Suwon-si (KR); Won Kyeong Lee, Guri-si (KR)

(73) Assignee: KT&G CORPORATION, Daejeon (KR)

( * ) Notice: Subject to any disclaimer, the term of this patent is extended or adjusted under 35 U.S.C. 154(b) by 939 days.

(21) Appl. No.: 16/981,538

(22) PCT Filed: Jun. 11, 2020

(86) PCT No.: PCT/KR2020/007567
§ 371 (c)(1),
(2) Date: Sep. 16, 2020

(87) PCT Pub. No.: WO2021/015413
PCT Pub. Date: Jan. 28, 2021

(65) Prior Publication Data

US 2021/0274841 A1 Sep. 9, 2021

(30) Foreign Application Priority Data

Jul. 23, 2019 (KR) ..... 10-2019-0089215

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/42; A24F 40/10; A24F 40/485; A24F 40/40; A24F 40/46; A24F 40/50
(Continued)

(56) References Cited

U.S. PATENT DOCUMENTS 9,439,455 B2 * 9/2016 Alarcon ..... A24F 40/51
10,244,793 B2 * 4/2019 Monsees ..... H05B 3/146
(Continued)

FOREIGN PATENT DOCUMENTS

CN 109965355 A 7/2019
JP 2013-524835 A 6/2013
(Continued)

OTHER PUBLICATIONS

Office Action dated Apr. 12, 2023 in Chinese Application No. 202080002290.7.
(Continued)

*Primary Examiner* — Alexander Gilman
(74) *Attorney, Agent, or Firm* — Sughrue Mion, PLLC

(57) ABSTRACT

An aerosol generating device includes a cartridge configured to generate aerosol from an aerosol generating material; and a main body comprising an accommodation space for accommodating the cartridge, wherein an airflow passage for introducing external air is formed between a wall of the main body adjoining the accommodation space and a wall of the cartridge when the cartridge is accommodated in the accommodation space of the main body.

9 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 11,439,184 | B2 * | 9/2022 | Bowen | A24F 40/51 |
| 2017/0027226 | A1 * | 2/2017 | Mironov | A24F 40/42 |
| 2017/0238605 | A1 * | 8/2017 | Matsumoto | A24F 40/485 |
| 2017/0325501 | A1 * | 11/2017 | Wanner | A24F 13/18 |
| 2017/0347715 | A1 * | 12/2017 | Mironov | A24F 40/42 |
| 2018/0070646 | A1 * | 3/2018 | Bowen | A61M 11/06 |
| 2018/0085551 | A1 * | 3/2018 | Krietzman | H05B 1/0252 |
| 2018/0153216 | A1 | 6/2018 | Wong et al. | |
| 2018/0242643 | A1 * | 8/2018 | Silvesstrini | A24F 40/46 |
| 2018/0271151 | A1 | 9/2018 | Litten | |
| 2019/0001087 | A1 * | 1/2019 | Davidson | A61M 15/0045 |
| 2019/0029326 | A1 * | 1/2019 | Qiu | A24F 40/44 |
| 2019/0082739 | A1 * | 3/2019 | Slivestrini | A24F 40/485 |
| 2019/0083720 | A1 | 3/2019 | Leadley et al. | |
| 2019/0098931 | A1 * | 4/2019 | Leadley | A61M 15/06 |
| 2019/0099561 | A1 * | 4/2019 | Nettenstrom | A61M 11/042 |
| 2019/0099567 | A1 * | 4/2019 | Nettenstrom | A61M 15/0021 |
| 2019/0104767 | A1 * | 4/2019 | Hatton | A24F 40/51 |
| 2019/0159519 | A1 * | 5/2019 | Bowen | A24F 40/51 |
| 2019/0166913 | A1 * | 6/2019 | Trzecieski | A61M 15/06 |
| 2019/0166915 | A1 * | 6/2019 | Nagata | A61M 15/06 |
| 2019/0191764 | A1 * | 6/2019 | Lin | A24F 40/40 |
| 2019/0200674 | A1 * | 7/2019 | Tucker | F21V 33/0004 |
| 2019/0208827 | A1 * | 7/2019 | Mironov | A24F 40/70 |
| 2019/0230989 | A1 * | 8/2019 | Fursa | A24F 40/485 |
| 2019/0254348 | A1 | 8/2019 | Garthaffner et al. | |
| 2020/0154765 | A1 * | 5/2020 | Lee | A24F 40/50 |
| 2020/0163378 | A1 | 5/2020 | Taschner et al. | |
| 2020/0288778 | A1 * | 9/2020 | Kim | H05K 1/0277 |

FOREIGN PATENT DOCUMENTS

| | | | |
|---|---|---|---|
| JP | 2018-500939 | A | 1/2018 |
| KR | 10-2016-0031801 | A | 3/2016 |
| KR | 10-2018-0116368 | A | 10/2018 |
| KR | 10-2019-0018693 | A | 2/2019 |
| KR | 10-2019-0033518 | A | 3/2019 |
| WO | 2015/117702 | A1 | 8/2015 |
| WO | 2015/177046 | A1 | 11/2015 |
| WO | 2017/167512 | A1 | 10/2017 |
| WO | 2018/050735 | A1 | 3/2018 |
| WO | 2018086828 | A1 | 5/2018 |
| WO | 2018/190606 | A1 | 10/2018 |
| WO | 2019/088579 | A2 | 5/2019 |

OTHER PUBLICATIONS

Extended European Search Report dated Nov. 10, 2021 in European Application No. 20767943.2.

Office Action dated Dec. 7, 2021 in Japanese Application No. 2020-562158.

International Search Report dated Sep. 17, 2020, in international Application No. PCT/KR2020/007567.

* cited by examiner

[Fig. 1]
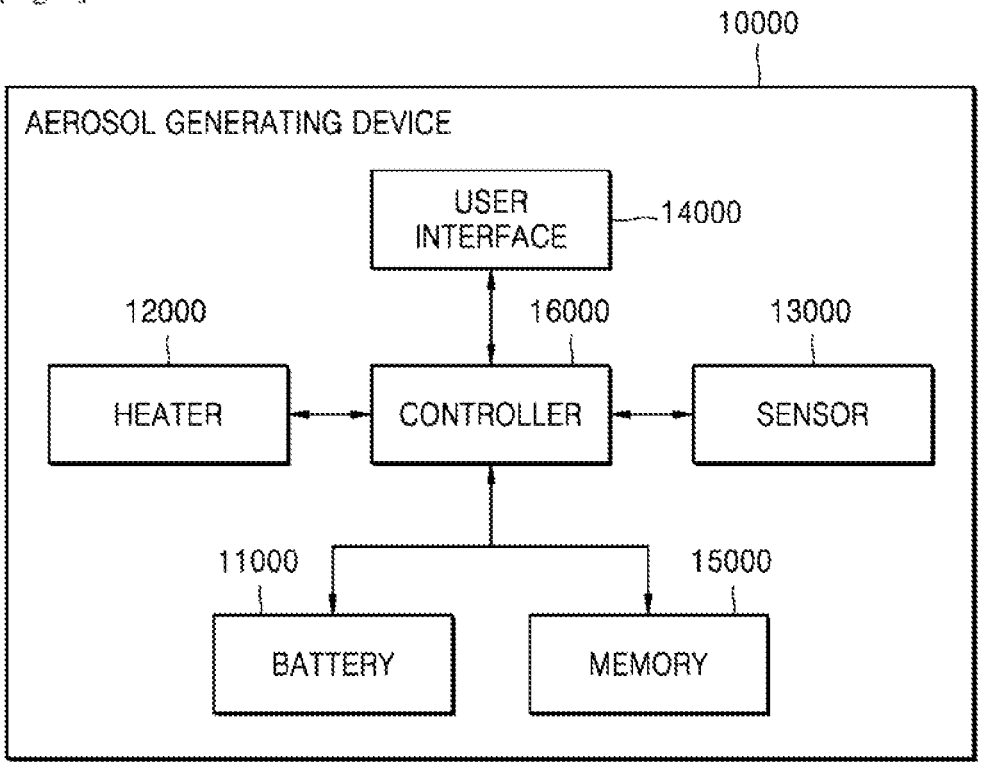

[Fig. 2]
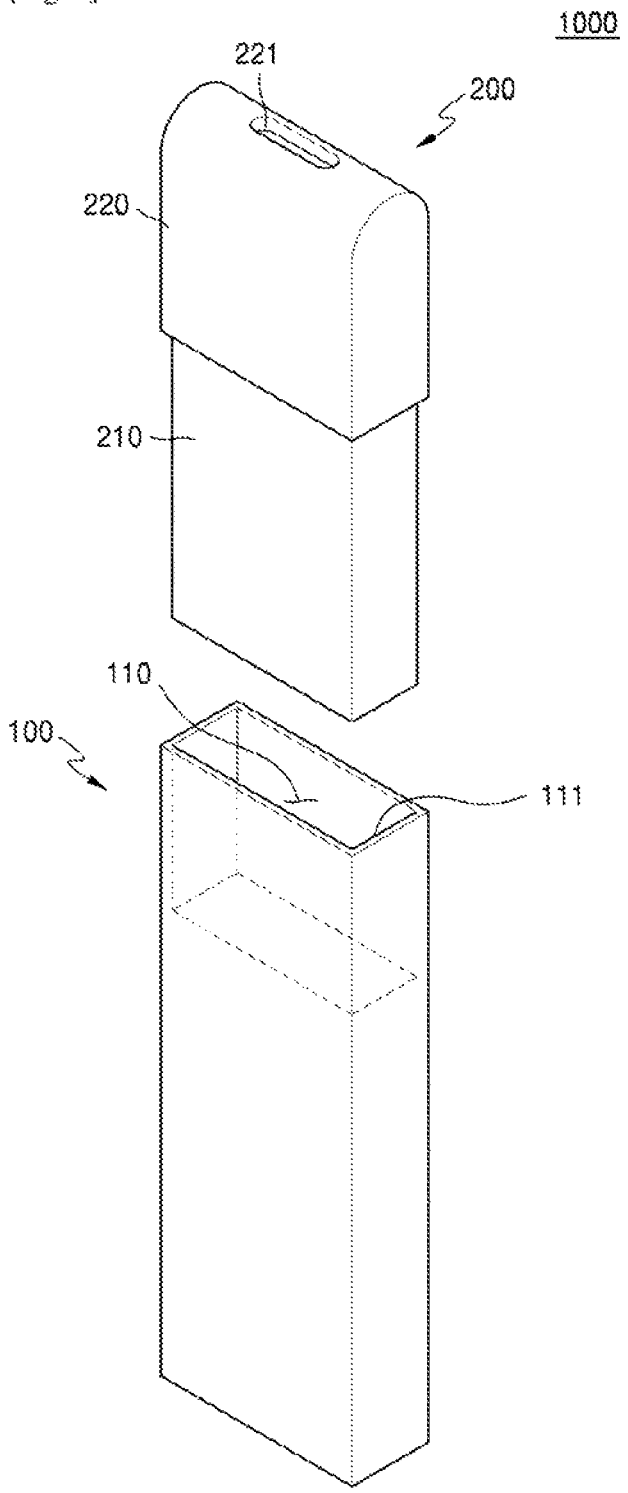

[Fig. 3]
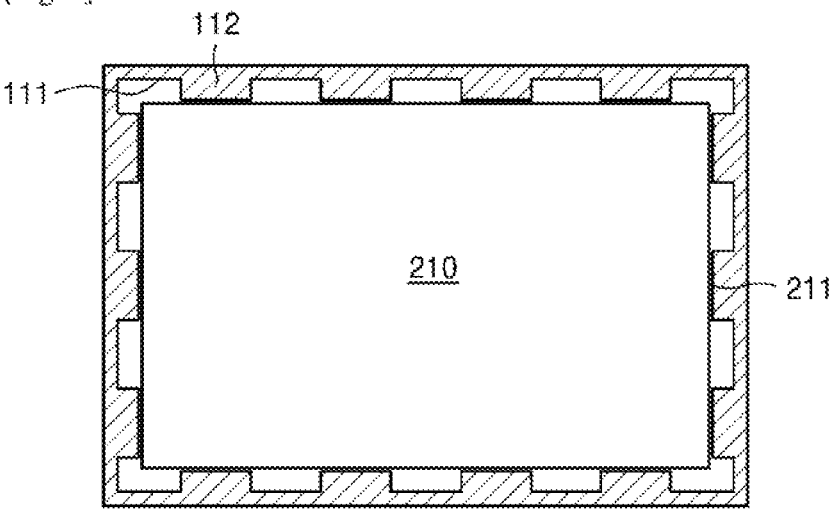
[Fig. 4]
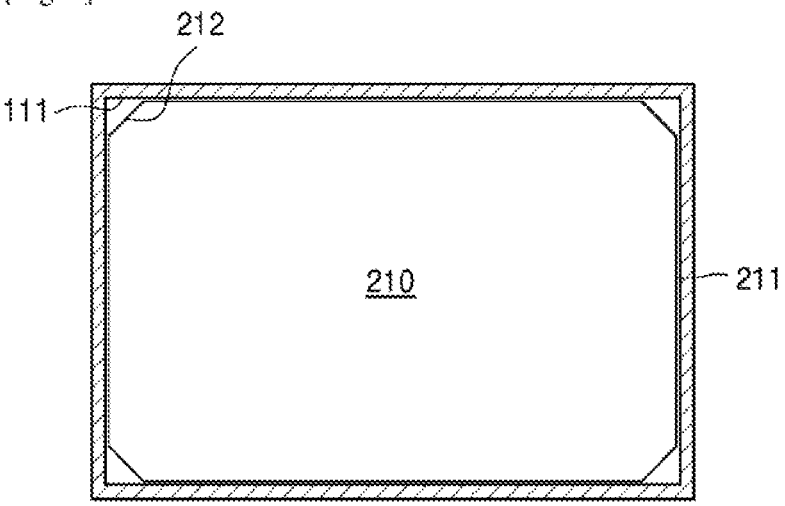

[Fig. 5]
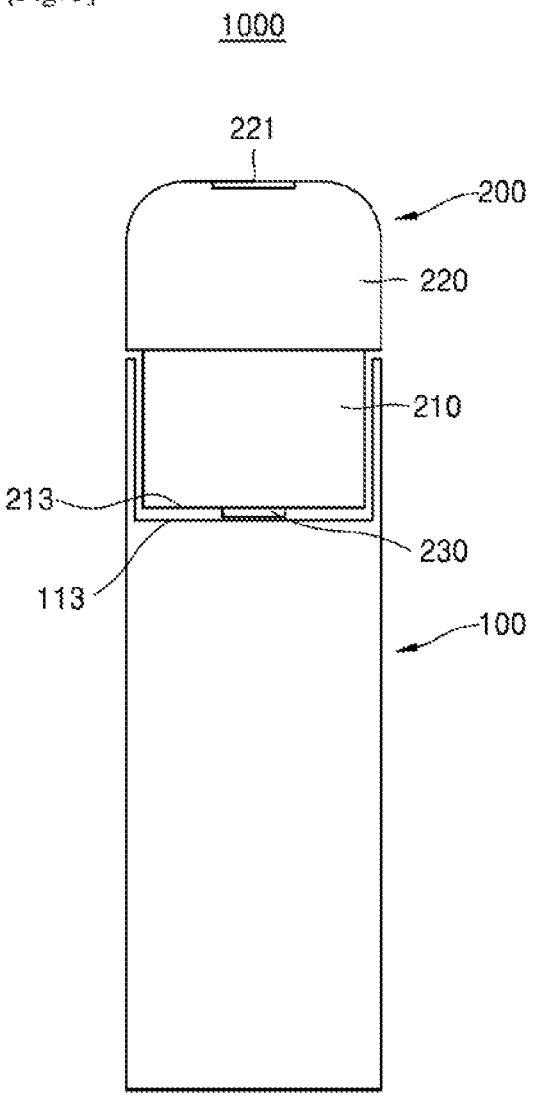

[Fig. 6]
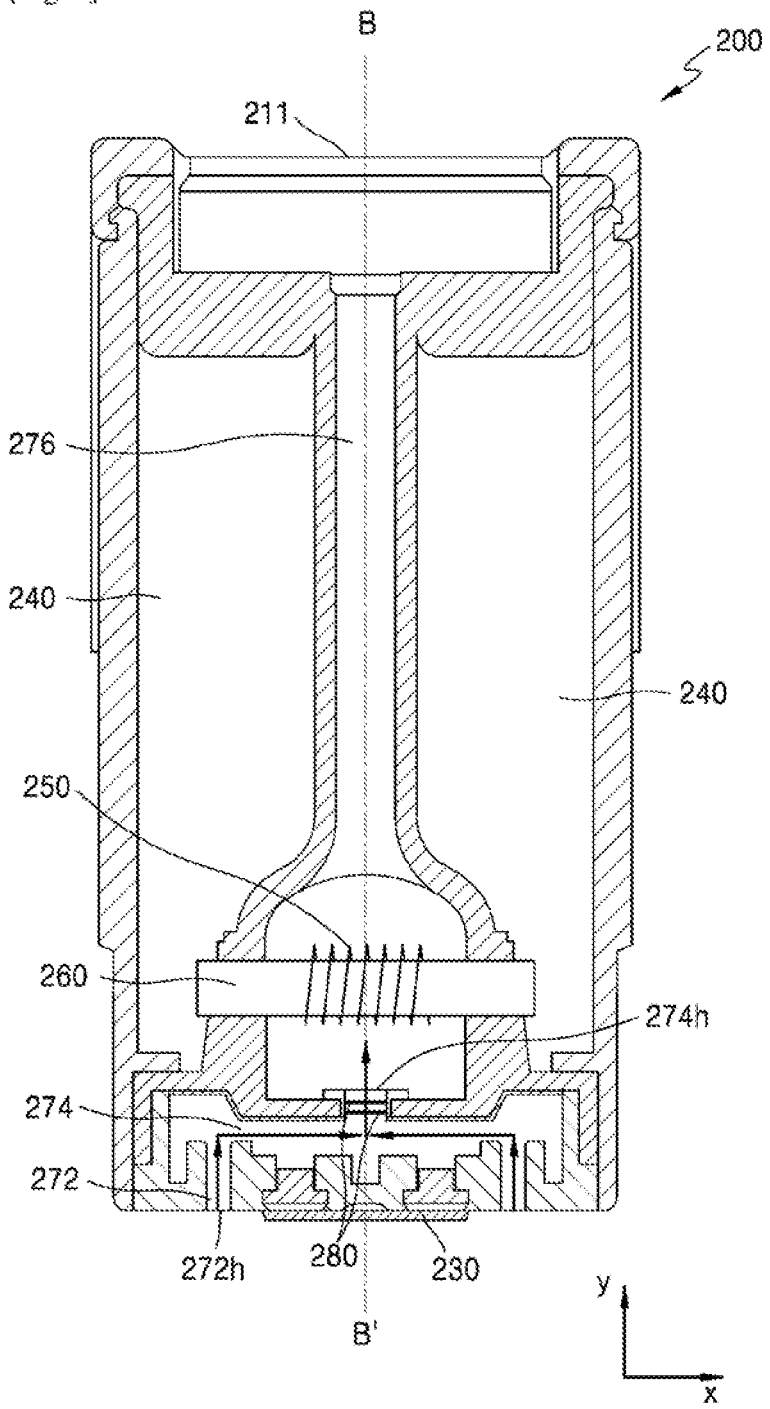

[Fig. 7]
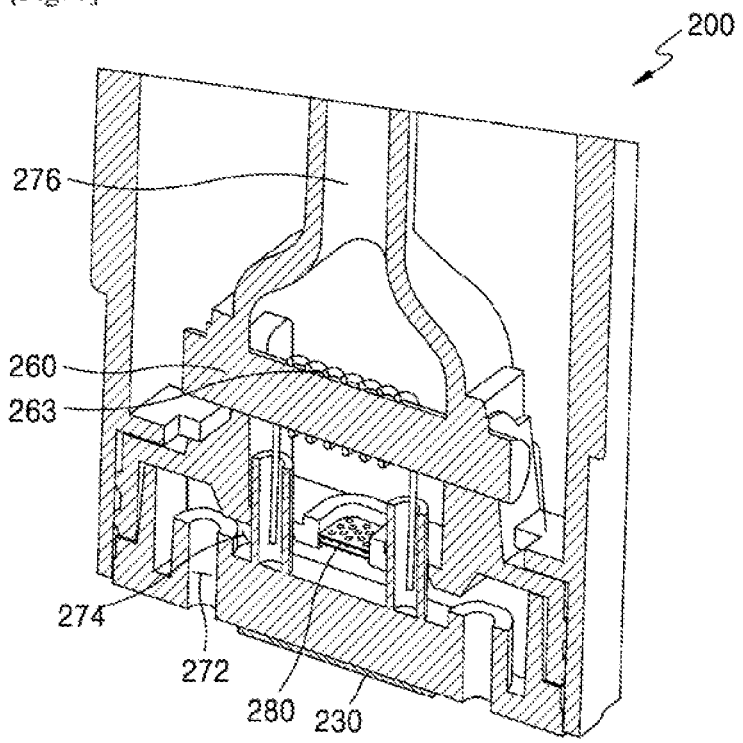

AEROSOL GENERATING DEVICE

CROSS REFERENCE TO RELATED APPLICATIONS

This application is a National Stage of International Application No. PCT/KR2020/007567, filed Jun. 11, 2020, claiming priority to Korean Patent Application No. 10-2019-0089215, filed Jul. 23, 2019.

TECHNICAL FIELD

Example embodiments relate to an aerosol generating device, and more particularly, to an aerosol generating device having a structure that provides appropriate puff resistance and prevents leakage from a cartridge.

BACKGROUND ART

Recently, the demand for alternative methods to overcome the shortcomings of traditional cigarettes has increased. For example, there is a growing demand for a method of generating aerosol by heating an aerosol generating material, rather than by combusting cigarettes. As a result, research into heating-type cigarettes and heating-type aerosol generating devices is being actively carried out.

In general, an aerosol generating device includes an airflow passage. The flow rate of air flowing through the airflow passage is directly related to the puff resistance of the aerosol generating device. However, it is very difficult to design an aerosol generating device that has appropriate puff resistance.

DISCLOSURE OF INVENTION

Solution to Problem

Example embodiments include aerosol generating devices. Example embodiments include aerosol generating devices capable of appropriately adjusting the puff resistance of an aerosol and preventing the leakage of a cartridge by a structure in which an airflow passage is formed.

The technical problems to be achieved by the example embodiments are not limited to those mentioned above, and other technical problems which are not mentioned may be clearly understood from the specification and the accompanied drawings by those of skill in the art from the following descriptions.

According to an example embodiment, an aerosol generating device includes a cartridge configured to generate an aerosol from an aerosol generating material; a main body comprising an accommodation space accommodating the cartridge; and an airflow passage through which external air may flow between an inner wall of the accommodation space and an outer wall of the cartridge when the cartridge is accommodated in the accommodation space of the main body.

Advantageous Effects of Invention

An aerosol generating device according to the example embodiments provides an easy way of providing a proper level of puff resistance and preventing leakage from a cartridge.

Effects by the example embodiments are not limited to the above-described effects, effects that are not mentioned will be clearly understood by those skilled in the art from the present specification and the accompanying drawings.

BRIEF DESCRIPTION OF DRAWINGS

The above and other aspects, features, and advantages of certain example embodiments of the disclosure will be more apparent from the following description taken in conjunction with the accompanying drawings, in which:

FIG. 1 is a block diagram illustrating hardware components of the aerosol generating device according to an embodiment.

FIG. 2 is an exploded perspective view schematically illustrating a coupling relationship between a replaceable cartridge containing an aerosol generating material and an aerosol generating device including the same, according to an embodiment.

FIG. 3 is a horizontal cross-sectional view of an aerosol generating device, showing a coupling portion where a main body and a cartridge are coupled to each other, according to an example embodiment.

FIG. 4 is a horizontal cross-sectional view of an aerosol generating device, showing a coupling portion where a main body and a cartridge are coupled to each other, according to another example embodiment.

FIG. 5 is a vertical cross-sectional view of an aerosol generating device, according to an example embodiment.

FIG. 6 is a vertical cross-sectional view of a cartridge of the aerosol generating device of the example embodiment shown in FIG. 5.

FIG. 7 is a partial perspective view of the cartridge of the example embodiment shown in FIG. 6.

BEST MODE FOR CARRYING OUT THE INVENTION

According to an example embodiment, an aerosol generating device includes a cartridge configured to generate aerosol from an aerosol generating material; and a main body comprising an accommodation space for accommodating the cartridge, wherein an airflow passage for introducing external air is formed between a wall of the main body adjoining the accommodation space and a wall of the cartridge when the cartridge is accommodated in the accommodation space of the main body.

At least one of the wall of the accommodation space and the wall of the cartridge may include a plurality of convex portions spaced apart from each other, such that the airflow passage is formed between the plurality of convex portions when the cartridge is accommodated in the accommodation space of the main body.

The cartridge may include a chamfer portion at edges, such that the airflow passage is formed between the chamfer portion and the wall of the accommodation space when the cartridge is accommodated in the accommodation space of the main body.

The cartridge may include a storage storing the aerosol generating material; and an atomizer disposed in the storage to generate the aerosol from the aerosol generating material.

A protrusion may be formed on at least one of a bottom surface of the cartridge and an opposite surface of the main body, the opposite surface facing the bottom surface when the cartridge is accommodated in the accommodation space, wherein a gap is formed between the bottom surface of the cartridge and the opposite surface of the main body, such that the gap is connected to the airflow passage.

The cartridge may further include an air inlet formed in the bottom surface of the cartridge such that external air is introduced through the air inlet.

The aerosol generating device may further include a plurality of screens disposed on a path through which the external air is introduced into the cartridge through the air inlet, and each of the plurality of screens may include a plurality of perforations that allow the external air to pass.

The plurality of perforations may not overlap between adjacent screens.

MODE FOR THE INVENTION

Reference will now be made in detail to example embodiments, examples of which are illustrated in the accompanying drawings, wherein like reference numerals refer to like elements throughout. In this regard, the present example embodiments may have different forms and should not be construed as being limited to the descriptions set forth herein. Accordingly, the example embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, an aerosol generating device may be a device that generates aerosol from an aerosol generating material so that a user may directly inhale the aerosol. For example, the aerosol generating device may be a holder.

Throughout the specification, a "puff" refers to user's inhalation, by which an inhalable material (e.g., aerosol) flows into the user's mouth, nasal cavity, or lung through the user's mouth or nose.

Hereinafter, the present disclosure will now be described more fully with reference to the accompanying drawings, in which example embodiments of the present disclosure are shown such that one of ordinary skill in the art may easily work the present disclosure. The disclosure can, however, be embodied in many different forms and should not be construed as being limited to the embodiments set forth herein.

FIG. 1 is a block diagram illustrating hardware components of the aerosol generating device according to an embodiment.

Referring to FIG. 1, the aerosol generating device 10000 may include a battery 11000, a heater 12000, a sensor 13000, a user interface 14000, a memory 15000, and a controller 16000. However, the internal structure of the aerosol generating device 10000 is not limited to the structure illustrated in FIG. 1. According to the design of the aerosol generating device 10000, it will be understood by one of ordinary skill in the art that some of the components shown in FIG. 1 may be omitted or new components may be added.

In an example embodiment, the aerosol generating device 10000 may include a main body without a cartridge, in which case the components of the aerosol generating device 10000 are located in the main body. In another example embodiment, the aerosol generating device 10000 may include a main body and a cartridge, in which case the components included in the aerosol generating device 10000 may be located in the main body and/or the cartridge.

Hereinafter, an operation of each of the components will be described without being limited to location of the components.

The battery 11000 supplies electric power to be used for the aerosol generating device 10000 to operate. In other words, the battery 11000 may supply power such that the heater 12000 may be heated. In addition, the battery 11000 may supply power required for operation of other components included in the aerosol generating device 10000, such as the sensor 13000, the user interface 14000, the memory 15000, the controller 16000, etc. The battery 11000 may be a rechargeable battery or a disposable battery. For example, the battery 11000 may be a lithium polymer (LiPoly) battery, but is not limited thereto.

The heater 12000 receives power from the battery 11000 under the control of the controller 16000. The heater 12000 may receive power from the battery 11000 and heat a cigarette inserted into the aerosol generating device 10000, or heat the cartridge mounted on the aerosol generating device 10000.

The heater 12000 may be located in the main body of the aerosol generating device 10000. Alternatively, if the aerosol generating device 10000 includes the main body and the cartridge, the heater 12000 may be located in the cartridge. If the heater 12000 is located in the cartridge, the heater 12000 may receive power from the battery 11000 located in the main body and/or the cartridge.

The heater 12000 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 12000 may be implemented by a metal wire, a metal plate on which an electrically conductive track is arranged, or a ceramic heating element, but is not limited thereto.

In an example embodiment, the heater 12000 may be included in the cartridge. The cartridge may include the heater 12000, the liquid delivery element, and the liquid storage. The aerosol generating material accommodated in the liquid storage may be absorbed by the liquid delivery element, and the heater 12000 may heat the aerosol generating material absorbed by the liquid delivery element, thereby generating aerosol. For example, the heater 12000 may include a material such as nickel or chromium and may be wound around or arranged adjacent to the liquid delivery element.

In another example embodiment, the heater 12000 may heat the cigarette inserted into the accommodation space of the aerosol generating device 10000. As the cigarette is accommodated in the accommodation space of the aerosol generating device 10000, the heater 12000 may be located inside and/or outside the cigarette. Accordingly, the heater 12000 may generate aerosol by heating the aerosol generating material in the cigarette.

Meanwhile, the heater 12000 may include an induction heater. The heater 13000 may include an electrically conductive coil for heating a cigarette or the cartridge by an induction heating method, and the cigarette or the cartridge may include a susceptor which may be heated by the induction heater.

The aerosol generating device 10000 may include at least one sensor 13000. A result sensed by the sensor 13000 is transmitted to the controller 16000, and the controller 16000 may control the aerosol generating device 10000 by controlling the operation of the heater, restricting smoking, determining whether a cigarette (or a cartridge) is inserted, displaying a notification, etc.

For example, the sensor 13000 may include a puff detecting sensor. The puff detecting sensor may detect a user's puff based on a temperature change, a flow change, a voltage change, and/or a pressure change.

In addition, the at least one sensor 13000 may include a temperature sensor. The temperature sensor may detect a temperature of the heater 12000 (or an aerosol generating material). The aerosol generating device 10000 may include a separate temperature sensor for sensing a temperature of the heater 12000, or the heater 12000 itself may serve as a temperature sensor without a separate temperature sensor. Alternatively, a separate temperature sensor may be further included in the aerosol generating device 10000 while the heater 12000 serves as a temperature sensor.

The user interface 14000 may provide the user with information about the state of the aerosol generating device 10000. For example, the user interface 14000 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and/or communication interfacing modules for performing wireless communication (for example, Wi-Fi, Wi-Fi direct, Bluetooth, near-field communication (NFC), etc.) with external devices.

The memory 15000 may store various data processed or to be processed by the controller 16000. The memory 15000 may include various types of memories, such as dynamic random access memory (DRAM), static random access memory (SRAM), read-only memory (ROM), electrically erasable programmable read-only memory (EEPROM), etc.

The memory 15000 may store an operation time of the aerosol generating device 10000, the maximum number of puffs, the current number of puffs, at least one temperature profile, data on a user's smoking pattern, etc.

The controller 16000 may control overall operations of the aerosol generating device 10000. The controller 16000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 16000 analyzes a result of the sensing by at least one sensor 13000, and controls processes that are to be performed subsequently.

The controller 16000 may control power supplied to the heater 12000 so that the operation of the heater 12000 is started or terminated, based on the result of the sensing by the at least one sensor 13000. In addition, based on the result of the sensing by the at least one sensor 13000, the controller 16000 may control the amount of power supplied to the heater 12000 and the time at which the power is supplied, so that the heater 12000 is heated to a predetermined temperature or maintained at an appropriate temperature.

In an example embodiment, the controller 16000 may set a mode of the heater 12000 to a pre-heating mode to start the operation of the heater 12000 after receiving a user input to the aerosol generating device 10000. In addition, the controller 16000 may switch the mode of the heater 12000 from the pre-heating mode to an operation mode after detecting a user's puff by using the puff detecting sensor. In addition, the controller 16000 may stop supplying power to the heater 12000 when the number of puffs reaches a preset number after counting the number of puffs by using the puff detecting sensor.

The controller 16000 may control the user interface 14000 based on the result of the sensing by the at least one sensor 13000. For example, when the number of puffs counted by the puff detecting sensor reaches a preset number, the controller 16000 may notify the user by using the user interface 14000 (e.g., a light emitter, a motor, a speaker, etc.) that the aerosol generating device 10000 will soon be terminated.

Although not illustrated in FIG. 1, the aerosol generating device 10000 may be combined with a separate cradle to form an aerosol generating system. For example, the cradle may be used to charge the battery 11000 of the aerosol generating device 10000. For example, the aerosol generating device 10000 may be supplied with power from a battery of the cradle to charge the battery 11000 of the aerosol generating device 10000 while being accommodated in an accommodation space of the cradle.

FIG. 2 is an exploded perspective view schematically illustrating a coupling relationship between a replaceable cartridge containing an aerosol generating material and an aerosol generating device including the same, according to an embodiment.

An aerosol generating device 1000 according to the embodiment illustrated in FIG. 2 includes the cartridge 200 containing the aerosol generating material and a main body 100 supporting the cartridge 200.

The cartridge 200 containing the aerosol generating material may be coupled to the main body 100. A portion of the cartridge 200 is inserted into an accommodation space 110 of the main body 100 so that the cartridge 200 may be mounted on the main body 100.

The cartridge 200 may contain an aerosol generating material in at least one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 1000, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid, and malic acid, or may be a mixture of two or more acids selected from the above-mentioned acids, but is not limited thereto.

The cartridge 200 is operated by an electrical signal or a wireless signal transmitted from the main body 100 to perform a function of generating aerosol by converting the phase of the aerosol generating material inside the cartridge 200 to a gaseous phase. The aerosol may refer to a gas in which vaporized particles generated from an aerosol generating material are mixed with air.

For example, in response to receiving the electrical signal from the main body 100, the cartridge 200 may convert the phase of the aerosol generating material by heating the aerosol generating material, using, for example, an ultrasonic vibration method or an induction heating method. In an embodiment, the cartridge 200 may include its own power source and generate aerosol based on an electric control signal or a wireless signal received from the main body 100.

The cartridge 200 may include a storage 210 accommodating the aerosol generating material therein, and an atomizer performing a function of converting the aerosol generating material of the storage 210 to aerosol.

When the storage 210 "accommodates the aerosol generating material" therein, it means that the storage 210 functions as a container simply holding an aerosol generating material and that the storage 210 includes therein an element impregnated with (i.e., containing) an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament made using a material such as a nichrome wire, and may be wound around or arranged adjacent to the liquid delivery element.

In addition, the atomizer may be implemented by a heating element in the form of a mesh or plate, which absorbs the aerosol generating material, maintains it in an optimal state for conversion to aerosol, and generates aerosol by heating the aerosol generating material. In this case a separate liquid delivery element may not be required.

At least a portion of the storage 210 of the cartridge 200 may include a transparent portion so that the aerosol generating material accommodated in the cartridge 200 may be visually identified from the outside. A mouthpiece 220 and/or the storage 210 may be entirely formed of transparent plastic or glass.

The main body 100 may include a connection terminal (not shown) arranged inside the accommodation space 110. When the storage 210 of the cartridge 200 is inserted into the accommodation space 110 of the main body 100, the main body 100 may provide power to the cartridge 200 or supply a signal related to an operation of the cartridge 200 to the cartridge 200, through the connection terminal.

The mouthpiece 220 is coupled to one end of the storage 210 of the cartridge 200. The mouthpiece 220 is a portion of the aerosol generating device 1000, which is to be inserted into a user's mouth. The mouthpiece 220 includes a discharge hole 221 for discharging aerosol generated from the aerosol generating material inside the storage 210 to the outside.

The aerosol generating device 1000 may include at least one airflow passage through which external air may be introduced. For example, the airflow passage may be a space formed between the accommodation space 110 of the main body 100 and the cartridge 200 coupled to the accommodation space 110. Therefore, the airflow passage through which external air may flow may be formed between the inner wall 111 of the accommodation space 110 (i.e., a surface of the main body 100 that forms the accommodation space 110) and the outer wall of the cartridge 200. The air introduced through the airflow passage may pass through the cartridge 200 and then be discharged through a mouthpiece. For example, opening and closing of the airflow passage formed in the aerosol generating device 1000 and/or the size of the airflow passage may be adjusted by the user. Accordingly, the amount and smoothness of smoke may be adjusted by the user.

In the aerosol generating device 1000 according to an embodiment, a horizontal cross section of the main body 100 and the cartridge 200 may be approximately rectangular, but example the shape of the aerosol generating device 1000 is not limited thereto. The aerosol generating device 1000 may have, for example, a cross-sectional shape of a circle, an ellipse, a square, or a polygon of various shapes. In addition, the aerosol generating device 100) is not necessarily limited to a structure that extends linearly in the longitudinal direction, and may have a streamlined shape or bent at a preset angle in a specific area to be easily held by the user.

FIG. 3 is a horizontal cross-sectional view of the aerosol generating device 1000, showing a coupling portion where the main body 100 and the cartridge 200 are coupled to each other, according to an example embodiment.

Referring to FIG. 3, when the main body 100 and the cartridge 200 of the aerosol generating device 1000 are coupled to each other, the storage 210 of the cartridge 200 is inserted into the accommodation space 110 of the main body 100. A plurality of convex portions 112 protruding toward the inside of the accommodation space 110 are formed in the inner wall 111 of the accommodation space 110. The plurality of convex portions 112 are spaced apart from each other, and the cartridge 200 extends in a direction in which the cartridge 200 is accommodated in the main body 100. Therefore, when the main body 100 and the cartridge 200 of the aerosol generating device 1000 are coupled to each other, an empty space may be formed by the inner wall 111 of the main body 100, the outer wall 211 of the storage 210, and the plurality of convex portions 112. An airflow passage may be formed by such spaces, and the external air may be introduced into the cartridge 200 through the airflow passage. Meanwhile, the plurality of convex portions 112 are not limited to the example embodiment shown in FIG. 3. In an embodiment, the plurality of convex portions 112 may be formed on the outer wall 211 of the storage 210 of the cartridge 200. Because of the convex portions 112, regions which the air flow is blocked and regions through which the air flow passes are alternately formed in the coupling portion. As a result, the area of the airflow passage may be reduced, in comparison with the case where the convex portions 112 are not formed. Therefore, leakage from the coupling portion may be prevented by the Venturi effect.

FIG. 4 is a horizontal cross-sectional view of the aerosol generating device 1000, showing a coupling portion where the main body 100 and the cartridge 200 are coupled to each other, according to another example embodiment.

Referring to FIG. 4, when the main body 100 and the cartridge 200 of the aerosol generating device 1000 are coupled to each other, the storage 210 of the cartridge 200 is inserted into the accommodation space 110 of the main body 100.

The cartridge 200 forms a chamfer portion 212 at the edges where adjacent outer walls 211 of the storage 210 meet each other. Therefore, when the main body 100 and the cartridge 200 of the aerosol generating device 1000 are coupled to each other, an empty space may be formed by the inner wall 111 of the main body 100 and the chamfer portion 212 of the storage 210. An airflow passage for introducing external air may be formed by the space formed by the inner wall 111 and the chamfer portion 212. Through the airflow passage, the inflow of the external air may be smoothly performed, and the area of the space (i.e., the airflow passage) formed by the chamfer portion 212 may be adjusted by adjusting the size of the chamfer portion 212. Therefore, the aerosol generating device 1000 may be designed to have an appropriate puff resistance by simply adjusting the size of the chamfer portion 212.

FIG. 5 is a vertical cross-sectional view of an aerosol generating device, according to an example embodiment.

Referring to FIG. 5, the protrusion 230 is formed on the bottom surface 213 of the storage 210 of the cartridge 200. When the cartridge 200 is accommodated in the accommodation space 110 of the main body 100, the bottom surface 213 faces the opposite surface 113 (i.e., the top surface) of the main body 100. Therefore, a gap is formed between the bottom surface 213 of the cartridge 200 and the opposite surface 113 of the main body 100 by the protrusion 230 of the cartridge 20. The gap formed between the bottom surface 213 and the opposite surface 113 may be connected to the airflow passages of the example embodiments illustrated in FIGS. 3 and 4 to allow the external air to flow in. In another embodiment, the protrusion 230 may be formed on the opposite surface 113 of the main body 10. In another embodiment, the protrusion 230 may be formed on both the bottom surface 213 of the storage 210 and the opposite surface 113 of the main body 100. The size of the gap formed between the bottom surface 213 of the storage 210 and the opposite surface 113 of the main body 100 may be adjusted by adjusting the height of the protrusion 230. Therefore, the aerosol generating device may be designed to have an appropriate puff resistance by simply adjusting the height of the protrusion 230.

FIG. 6 is a vertical cross-sectional view of the cartridge 200 of an aerosol generating device of the example embodiment shown in FIG. 5, and FIG. 7 is a partial perspective view of the cartridge 200 of the example embodiment shown in FIG. 6.

Referring to FIGS. 6 and 7, the cartridge 200 may include the storage 210, a wick 260, and an aerosol discharge passage 276. As described above, the storage 210 may store an aerosol generating material in its empty space 240. The wick 260 may be connected to the storage 210 to deliver the aerosol generating material stored in the storage 210 to a heating element 250. The heating element 250 may generate aerosol by heating the aerosol generating material of the wick 260. The aerosol may be discharged in the extension direction of the aerosol discharge passage 276 through the aerosol discharge passage 276.

Throughout the specification, the y-axis direction is a direction in which the aerosol is discharged through the aerosol discharge passage 276. In general, the y-axis direction is identical to a proximal direction closer to a user and opposite to the gravity direction. However, when the aerosol generating device is inclined according to the usage form, the opposite direction of the y-axis direction is not necessarily identical to the gravity direction. In the specification, the y-axis direction may be referred to as an "upward" direction, and the opposite direction of the y-axis direction may be referred to as a "downward" direction.

The x-axis direction is perpendicular to the extension direction of the y-axis.

The storage 210 includes an outer wall and an empty space 240 surrounded by the outer wall. The aerosol generating material may be stored in the empty space 240 of the storage 210. The outer wall of the storage 210 may be a housing that forms the exterior of the cartridge 200.

The storage 210 may be manufactured in various shapes. According to an example embodiment, the storage 210 may have a cylindrical or rectangular parallelepiped shape extending along the y-axis, but is not limited thereto.

The storage 210 may be shaped to surround and enclose the aerosol discharge passage 276. The storage 210 may have a height that corresponds to the length of the aerosol discharge passage 276.

The wick 260 may be connected to the storage 210 to receive the stored aerosol generating material. The wick 260 may carry the aerosol generating material from the storage 210 and transfer the aerosol generating material to the heating element 250. The wick 260 may be a hygroscopic fiber that absorbs the aerosol generating material in the state of liquid or gel. The wick 260 may carry the aerosol generating material by absorbing the aerosol generating material through an end portion connected to the storage 210. Alternatively, according to an example embodiment, the wick 260 may have a thin tubular shape and may carry the aerosol generating material through the interior of a tube by using the capillary phenomenon.

The shape of the wick 260 may vary. For example, the wick 260 has an elongated shape extending in the x-axis direction.

Both end portions or one end portion of the wick 260 may be connected to the storage 210 so that the aerosol generating material may be discharged from the storage 210 along the wick 260. The aerosol generating material in the storage 210 is prevented from leaking out of the storage 210 through a path other than the wick 260.

The heating element 250 may heat the aerosol generating material carried by the wick 260, and when the heating temperature is higher than or equal to the vaporization temperature of the aerosol generating material, the aerosol generating material may be vaporized to generate an aerosol.

The heating element 250 may be disposed in one region of the wick 260. The heating element 250 may be located on the extension line of the aerosol discharge passage 276. At this time, the heating element 250 may be disposed in the central region of the elongated wick 260. That is, the heating element 250 may be located between two legs of the aerosol discharge passage 276. In other words, the heating element 250 may be located in a vaporization chamber formed by the aerosol discharge passage 276 and the wick 260.

The heating element 250 may be in the form of a coil surrounding the wick 260. Alternatively, the heating element 250 may deliver heat to the wick 260 while being spaced apart from the wick 260.

The aerosol discharge passage 276 provides a path through which the aerosol is discharged. The aerosol discharge passage 276 may extend vertically, and the aerosol may move in the y-axis direction along the aerosol discharge passage 276. The mouthpiece 220 is positioned in the y-axis direction from the wick 260.

The aerosol discharge passage 276 may be surrounded by the empty space 240 of the storage 210. The aerosol generating material is stored in the empty space 240 formed between the outer wall of the storage 210 and the outer wall of the aerosol discharge passage 276.

The extension line B-B' is a central line of the aerosol discharge passage 276. In other words, the extension line B-B' divides a width (i.e., a length in the x-axis direction) of the aerosol discharge passage 276 in half. In this case, the extension line B-B' may be located at the center of the storage 210. According to an example embodiment, the storage 210 and the cartridge 200 may be symmetric with respect to the extension line B-B'.

A lower end portion of the aerosol discharge passage 276 may be in contact with the wick 260 to fix the wick 260. The lower end portion of the aerosol discharge passage 276 may have various shapes, and, for example, may include a first leg and a second leg, which extend in different directions.

An upper end portion of the aerosol discharge passage 276 is connected to the discharge hole 221 of the mouthpiece 220. The width (i.e., a length in the x-axis direction) of the mouthpiece 220 may be wider than the x-axis width of the aerosol discharge passage 276, but is not limited thereto.

The vaporization chamber is a region where the aerosol generating material is vaporized to generate the aerosol. For example, the vaporization chamber is a space surrounded by the lower end portion of the aerosol discharge passage 276 and the wick 260 when the lower end portion of the aerosol discharge passage 276 is in contact with the wick 260, and the heating element 250 is disposed in the vaporization chamber. The heat generated from the heating element 250 stays in the vaporization chamber, and thus heating efficiency in the vaporization chamber may be improved. The aerosol vaporized in the vaporization chamber moves upward along the aerosol discharge passage 276.

An airflow passage for introducing external air flows may be formed in a coupling portion where the cartridge 200 is coupled to the main body 100. For example, the airflow passage may be formed at the bottom surface 213 of the storage 210 and include an inlet **272*h* through which the external air enters, a first path 272 through which the external air passing through the inlet 272*h*, a second path 274 through which the external air passing through the first path 272 passes, and an outlet 274*h* through which the external air passing through the second path 274** enters into the vaporization chamber.

Meanwhile, a plurality of inlets **272*h*, a plurality of first paths 272 respectively connected to the plurality of inlets 272*h*, and a plurality of second paths 274 respectively connected to the plurality of first paths 272 may be provided. The plurality of inlets 272*h* may be disposed at both sides of the extension line B-B'. The inlet 272*h* may include a first inlet and a second inlet, and the first inlet and the second inlet may be at the opposite sides of the extension line B-B'. The external air introduced through the first inlet may pass through the first path 272 and the second path 274, sequentially, as described above. Similarly, the external air introduced through the second inlet may paths corresponding to the first path 272 and the second path 274**.

The external air introduced through the first inlet and the external air introduced through the second inlet may be merged, and enter the vaporization chamber through the outlet **274*h***.

A plurality of screens 280 are disposed between the inlet **272*h* and the outlet 274*h*. For example, in the example embodiment illustrated in FIGS. 6 and 7, the plurality of screens 280 are disposed adjacent to the outlet 274*h*, and a plurality of perforations through which external air may pass may be formed in the plurality of screens 280. The screens 280 may be arranged to have a predetermined interval. Even if the aerosol is cooled in the vaporization chamber to generate droplets, the droplets are prevented from flowing past the plurality of screens 280**.

In an embodiment, the plurality of perforations may be formed in the plurality of screens 280 such that perforations of adjacent screens do not overlap. As a result, since the perforations of the respective screens 280 do not overlap each other, even if the droplets are formed in the vaporization chamber, the droplets are prevented from leaking through the plurality of screens 280. Meanwhile, the plurality of perforations formed in the plurality of screens 280 may be formed in various sizes and arrangements, and are not limited by the shape illustrated in FIG. 7.

The descriptions of the above-described example embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

At least one of the components, elements, modules or units (collectively "components" in this paragraph) represented by a block in the drawings such as the controller 1600 and the user interface 1400 in FIG. 1, may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Furthermore, the components represented by a block or processing steps may employ any number of related art techniques for electronics configuration, signal processing and/or control, data processing and the like.

It should be understood that example embodiments described herein should be considered in a descriptive sense only and not for purposes of limitation. Descriptions of features or aspects within each example embodiment should typically be considered as available for other similar features or aspects in other example embodiments. While one or more example embodiments have been described with reference to the figures, it will be understood by those of ordinary skill in the art that various changes in form and details may be made therein without departing from the spirit and scope of the disclosure as defined by the following claims.

The invention claimed is:

1. An aerosol generating device comprising:

a cartridge configured to generate aerosol from an aerosol generating material; and a main body comprising an accommodation space that is configured to accommodate the cartridge, wherein an airflow passage, that is configured to introduce external air, is formed between a wall of the main body adjoining the accommodation space and a wall of the cartridge based on the cartridge being accommodated in the accommodation space of the main body, and wherein:

at least one from among the wall of main body adjoining the accommodation space and the wall of the cartridge comprises a plurality of projection portions spaced apart from each other, such that the airflow passage is formed between the plurality of projection portions based on the cartridge being accommodated in the accommodation space of the main body; or the cartridge comprises a chamfer portion at edges, such that the airflow passage is formed between the chamfer portion and the wall of the main body adjoining the accommodation space based on the cartridge being accommodated in the accommodation space of the main body.

2. The aerosol generating device of claim 1, wherein the accommodation space of the main body is configured to receive the cartridge in a first direction, and the airflow passage is between the wall of the main body and the wall of the cartridge in a second direction, perpendicular to the first direction, and extends in the first direction between the wall of the main body and the wall of the cartridge.

3. The aerosol generating device of claim 1, wherein that least one from among the wall of the main body adjoining the accommodation space and the wall of the cartridge comprises the plurality of projection portions spaced apart from each other, such that the airflow passage is formed between the plurality of projection portions based on the cartridge being accommodated in the accommodation space of the main body.

4. The aerosol generating device of claim 1, wherein the cartridge comprises the chamfer portion at the edges, such that the airflow passage is formed between the chamfer portion and the wall of the main body adjoining the accommodation space based on the cartridge being accommodated in the accommodation space of the main body.

5. The aerosol generating device of claim 1, wherein the cartridge comprises:

a storage configured to store the aerosol generating material; and an atomizer disposed in the storage to generate the aerosol from the aerosol generating material.

6. The aerosol generating device of claim 1, wherein a protrusion is formed on at least one from among a bottom surface of the cartridge and an opposite surface of the main body, the opposite surface facing the bottom surface of the cartridge based on the cartridge being accommodated in the accommodation space, wherein a gap is formed between the bottom surface of the cartridge and the opposite surface of the main body, such that the gap is connected to the airflow passage.

7. The aerosol generating device of claim 6, wherein the cartridge further comprises an air inlet formed in the bottom surface of the cartridge such that the external air is introduced through the air inlet.

8. The aerosol generating device of claim 7, further comprising a plurality of screens disposed on a path through which the external air is introduced into the cartridge through the air inlet, wherein each of the plurality of screens comprises a plurality of perforations that allow the external air to pass.

9. The aerosol generating device of claim 8, wherein the plurality of perforations do not overlap between adjacent screens.

* * * * *